United States Patent [19]

Arnold

[11] Patent Number: 4,625,927

[45] Date of Patent: Dec. 2, 1986

[54] APPARATUS FOR WINDING ELECTRICAL COILS WITH CLOSED CORES

[75] Inventor: Ernst Arnold, Buchs, Switzerland

[73] Assignee: Meteor AG, Rueschlikon, Switzerland

[21] Appl. No.: 644,510

[22] Filed: Aug. 27, 1984

[30] Foreign Application Priority Data

Jul. 23, 1984 [WO] PCT Int'l Appl. ..... PCT/CH84/00115

[51] Int. Cl.[4] ..... H01F 41/08

[52] U.S. Cl. ..... 242/4 R; 29/605

[58] Field of Search ..... 242/4 R; 29/605

[56] References Cited

U.S. PATENT DOCUMENTS

| | | | |
|---|---|---|---|
| 2,962,235 | 11/1960 | Ridler et al. | 242/4 R |
| 3,212,947 | 10/1965 | Vanzo | 242/4 R |
| 3,967,786 | 7/1976 | Ivanov | 242/4 R |
| 4,424,939 | 1/1984 | Ohashi et al. | 242/4 R |

FOREIGN PATENT DOCUMENTS

| | | |
|---|---|---|
| 0068415 | 6/1983 | European Pat. Off. . |
| 1228719 | 6/1967 | Fed. Rep. of Germany . |
| 1764512 | 8/1971 | Fed. Rep. of Germany . |
| 2052021 | 4/1972 | Fed. Rep. of Germany . |
| 2414302 | 3/1974 | Fed. Rep. of Germany . |
| 2251140 | 5/1974 | Fed. Rep. of Germany . |
| 8400077 | 1/1984 | World Int. Prop. O. . |

*Primary Examiner*—Billy S. Taylor

*Attorney, Agent, or Firm*—Burns, Doane, Swecker & Mathis

[57] ABSTRACT

The automatic winding of extremely small electrical core coils, for example video core coils, takes place on a rotatable winding unit which cooperates with a wire drawing apparatus provided with a catch hook. Each coil former receiver is provided with an associated wire mount. During the winding, the coil former together with the coil former receiver is immobile wherein the wire section of the winding wire necessary for each core coil is drawn from a wire storage coil over a wire deflector. During the winding of the core coil the rotatable winding unit, together with a plurality of wire retainers arranged in a vertically adjustable winding head, can be positioned so that the catch hook passes horizontally not only through one of the wire retainers but also through the core opening in the coil former. After applying the winding wire to one limb of the coil former during the withdrawal of the catch hook through the core opening, the cyclic rotation of the wire retainers then takes place through 270° whereupon a complete turn is formed.

3 Claims, 11 Drawing Figures

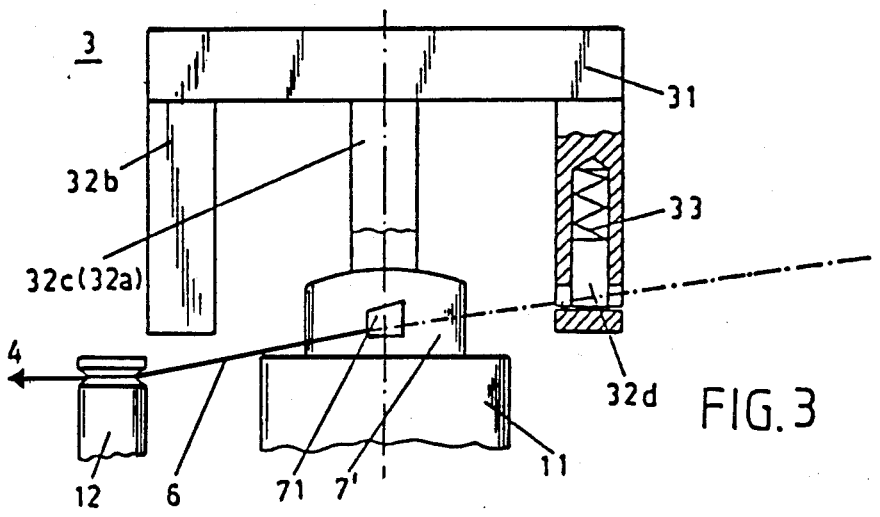
FIG. 3
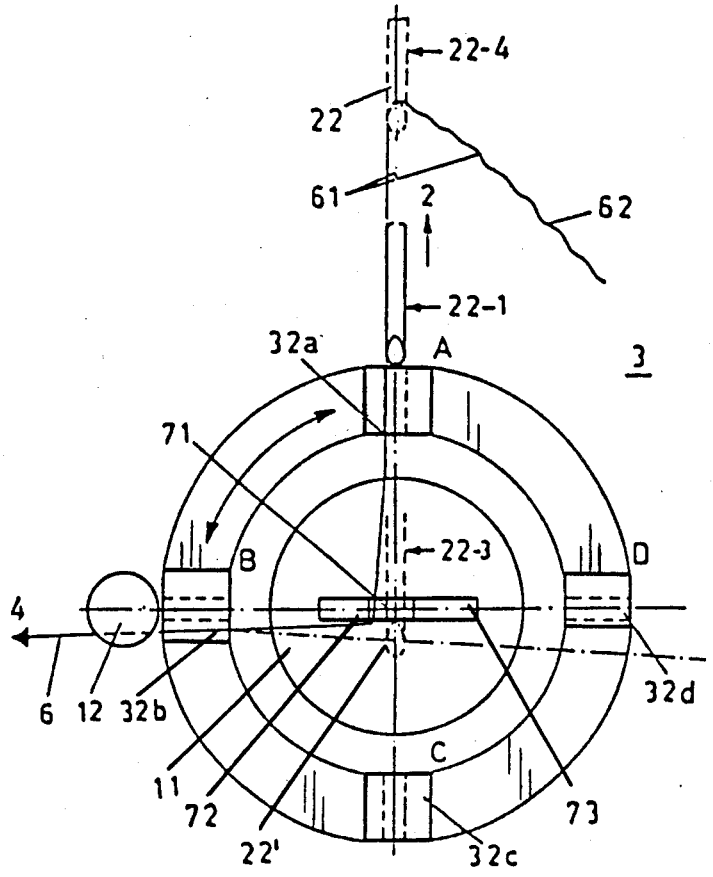
FIG. 3'
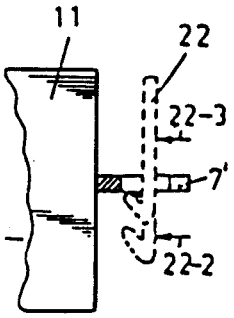
FIG. 3"

APPARATUS FOR WINDING ELECTRICAL COILS WITH CLOSED CORES

BACKGROUND OF THE INVENTION

The present invention relates to an apparatus for winding electrical coils with closed cores of the type having a coil former receiver provided on a support, a wire supply device, and loading and unloading stations for unwound and wound cores respectively.

In known ring core coil-winding devices, wherein annular magazines that are guided through the core opening are rotatably mounted and circulate around the coil formers, the wire runs from the magazine to the coil former over a wind-off roller. These devices are only suitable for relatively large ring cores. Typically, cores with an outer diameter of about 20 mm are considered to be the smallest size that such a device can accomodate.

In order to wind small ring cores having an annular core outer diameter of 16 mm or less, a semi-automatic winding method and an apparatus has been disclosed in European Patent Application No. 0068 415. In the disclosed system, the wire is wound on the core by means of a magnetizable needle fixed to the lead end of the winding wire. The needle is guided under the action of a magnetic field along a closed orbit that extends partly through the core opening and that is reduced in length as the winding period increases.

However, due to the use of magnets to guide the needle, such a winding device is not suitable for extremely small cores, for example for video core coils having an outer core diameter of the order of about 3 mm and a core opening of about 0.35 mm.

OBJECTS AND BRIEF STATEMENT OF THE INVENTION

The present invention is directed to the problem of providing an apparatus which is suitable for winding extremely small core coils of the order of about 3 mm core outer diameter with a core opening of about 0.35 mm. It is a specific object of the invention to provide such an apparatus that enables automatic winding to be obtained up to the finished wound core coil.

These objects are achieved in accordance with the present invention by arranging a wire mount on each coil former receiver. A winding unit comprising four wire retainers mounted in a rotatable head and a wire drawing device having a catch hook are provided so that the catch hook can pass through the wire retainer and the core opening in the coil former. Wire deflectors and a separating device are arranged between the wire mounts to cut each wire section to length.

An advantage of the invention particularly lies in the fact that the coil former is fixed to the coil former receiver during the entire winding operation of the core coil. In addition, the winding wire is permanently held and guided during the winding of the core coil whilst the entire length of the wire section for each winding is clamped in the wire mount, whereby the distance between the wire mount located in the winding position and the separating device corresponds respectively to a wire section necessary for the winding. For each individual winding, the winding wire is only lightly urged into one of the four wire retainers by an adjustable spring so that after each winding the wire can slightly slide through it. Moreover, the wire is inserted in the coil former by means of the catch hook before the rotation of the wire retainer whereupon the wire retainer is rotated through 270° and a respective winding is thus applied to the coil former.

The invention will be described in more detail hereinafter with reference to a preferred embodiment illustrated in the drawings.

DETAILED DESCRIPTION OF THE ILLUSTRATED EMBODIMENT

Figure 1:
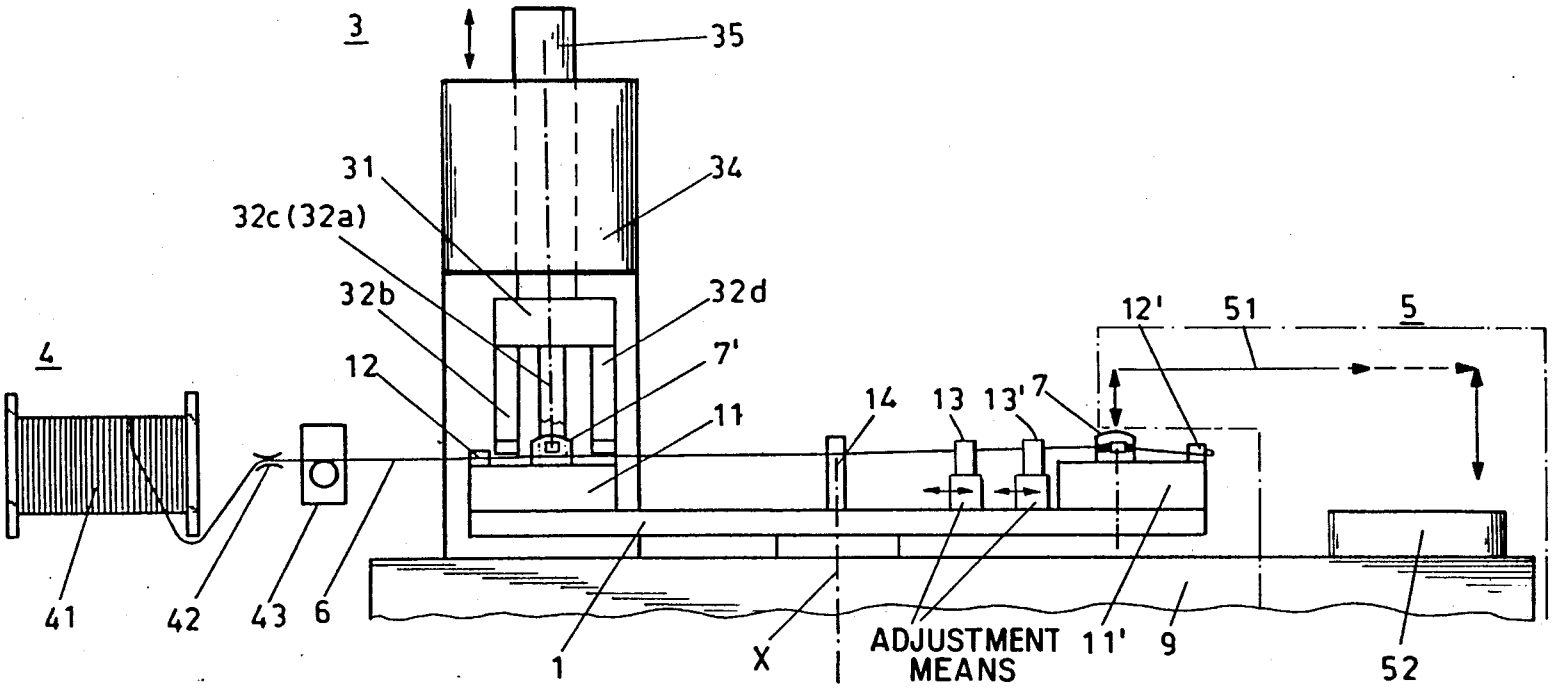
FIG. 1 is a wide view of a winding apparatus constructed in accordance with the invention.
Figure 2:
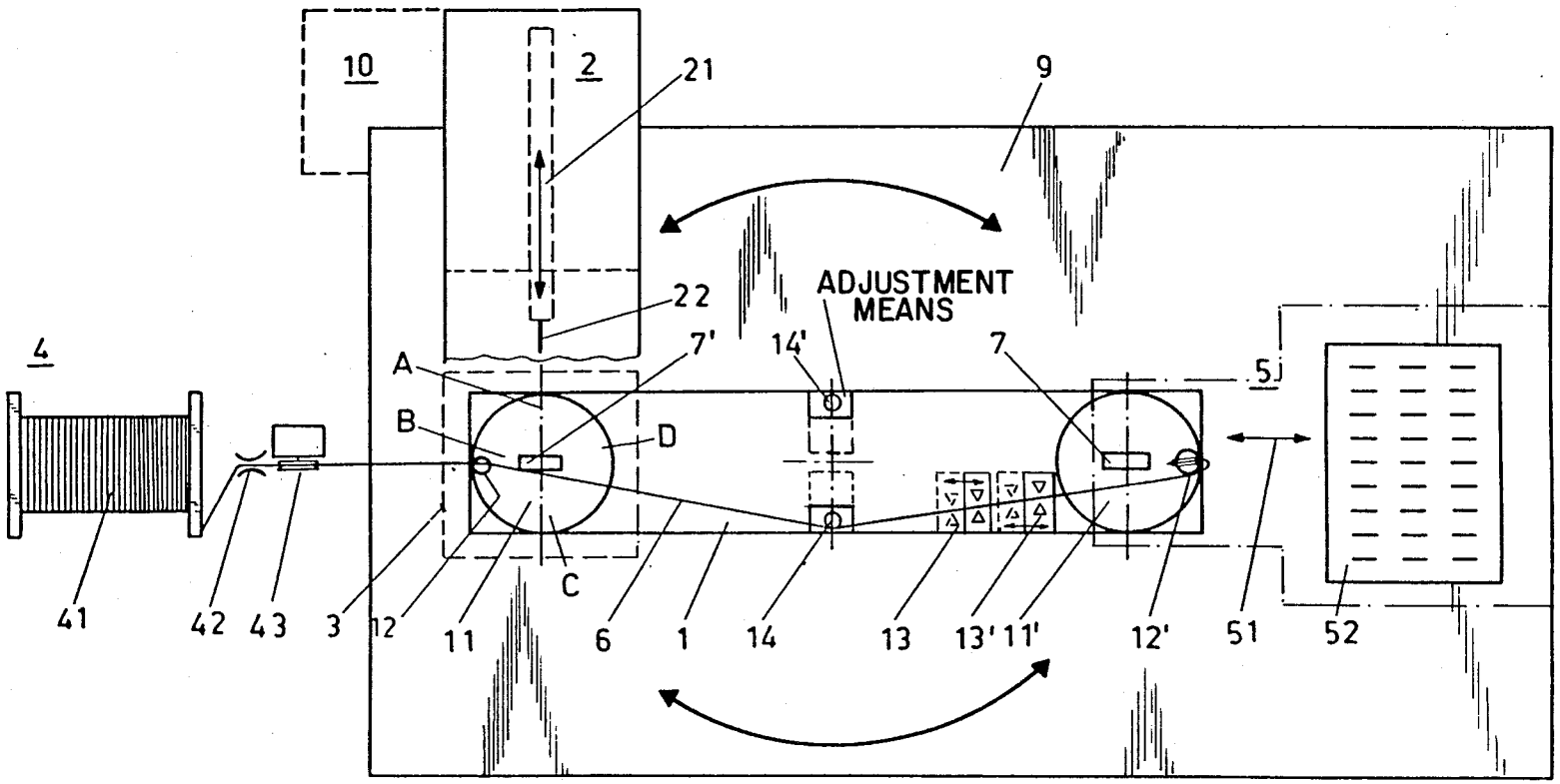
FIG. 2 is a plan view of the apparatus shown in FIG. 1.

Referring to FIGS. 1 and 2, a support 1, for example a rectangular rotatable turret which is rotatable through 180° about a rotary axis X, is arranged on a base plate 9. Two coil former receivers 11,11' are arranged on the turret 1. Each receiver has a wire mount 12,12'. One of the coil former receivers 11' is located in the region of a coil magazine 52 and the second coil former receiver 11 is located in the winding position, with the wire mount 12 being located in the region of a wire supply device 4. The coil magazine 52 is a component of a loading and unloading station 5 which has a transfer device 51. The wire supply device 4 consists of a storage coil 41 for a winding wire 6, a wire guide 42 and a wire brake 43. The winding of a coil former 7' takes place, as shown in FIG. 1, by a rotatable winding unit 3 which cooperates with a wire drawing device 2 illustrated in FIG. 2.

A pair of wire deflectors 14,14' and a separating device 13 preferably comprising two separating locations 13,13' are provided to adjust the length of the wire necessary to wind the two limbs 72,73 of each coil former 7'. Preferably each of the wire deflectors 14, 14' comprise cylindrical pins which are laterally adjustable in position relative to the turret 1 by conventional expedients, such as with a base member slideably coupled in a groove in the turret 1 and a set screw for fixing the position of the base member at locations along the groove. Likewise, each of the separating locations 13, 13' comprise conventional cutters which are preferably longitudinally adjustable in position relative to the turret 1 by conventional expedients, such as with a base member slideably coupled in a groove in the turret 1 and a set screw for fixing the position of the base member at locations along the groove. The winding unit 3 includes a winding head 31 comprising four wire retainers, or stretchers, 32*a*,32*b*,32*c*,32*d* each of which has an adjustable spring-loaded clamp 33 (FIG. 3) for clamping the winding wire 6. The winding head 31, together with the wire retainers 32*a*,32*b*,32*c*,32*d*, is driven by a winding head drive 34 and can be vertically raised and lowered by an adjusting device 35.

The wire drawing device 2 is powered by conventional drive means 10, for example a step motor, for shifting a catch hook 22 horizontally guided in a guide 21 into various positions labelled 22-1, 22-2, 22-3, 22-4 in FIGS. 3,3' and 3''. The catch hook 22 passes through the wire retainers 32*a*,32*b*,32*c*,32*d*, and the core opening 71 of the coil core 7' whereby the free wire end 62 of the wire section is drawn through one of the wire retainers 32a,32b,32c,32d and the core opening 71 in the form of a wire loop 61. The wire retainers 32a,32b,32c,32d are rotable together with the winding head 31 in both clockwise and counterclockwise directions. A cyclic rotary movement of the wire retainers 32a,32b,32c,32d through 270° takes place for each winding 81 through the winding positions A,B,C,D etc. as shown in the sequence of events depicted in FIGS. 3,3a and 3b. The individual working positions, particularly of the catch hook 22 and of the wire retainers 32a,32b,32c,32d, are selectable in a conventional manner by a controlled driving device 10 of the winding apparatus. For example, this driving device can be a computer having image screen monitoring for performing numerical control type functions.

As illustrated diagrammatically in FIGS. 3,3',3" to 3c, 3c' the method of operation of the apparatus in accordance with the invention is as follows:

The winding wire 6 supplied from the wire storage coil 41 through the guide 42 and the wire brake 43 is retained in the winding position in the wire mount 12 of the coil former receiver 11. As shown in FIGS. 1 and 2, the winding wire 6 held in the wire mount 12', together with the finished wound core coil 7, is brought into the region of the loading and unloading station 5 by rotation of the turret 1 through 180°. By rotating the turret 1, the winding wire 6 is guided over one of the two wire deflectors 14,14', as shown in FIG. 2, wherein the length of the wire section necessary for winding a core coil 7 is established between the wire mount 12 located in the winding position and the adjustable separating device 13.

Consequently, before the winding of the coil former 7', the winding wire 6 is held in the wire mounts 12,12' between which the winding wire 6 is guided under tension in the region of the core opening 71 of the coil former 7' over the wire deflector 14 or 14' and the separating device 13. This initial position of the winding wire 6 is illustrated in dotted lines in FIGS. 3,3'.

The catch hook arranged in the initial position 21-1 directly outside the wire retainer 32a located in the winding position A is displaced horizontally with respect to the still unwound coil former 7' so that it passes first through the open wire retainer 32a and then through the core opening 71 of the coil former 7'. The downwardly directed hook comes to rest above the tensioned winding wire 6 in the position 22-2 as shown in FIG. 3". Subsequently, the catch hook 22 is backed slightly into position 22-3 (likewise shown dotted in FIG. 3") whereby the winding wire 6 tensioned between the wire mounts 12, 12' is trapped and held directly in front of the core opening 71. The thus held winding wire 6 for the coil former 7' is then cut by the separating device 13. The separating device 13 can be so designed that two separating locations 13,13' which are adjustable with respect to each other are provided, in order to be able to adjust to an appropriate length the length of the required wire section for the coil former 7' to be wound and the length of the end of the winding of the finished core coil 7. In the latter case, the wire portion between the separating locations 13,13' would be rejected as waste.

Figure 3A:
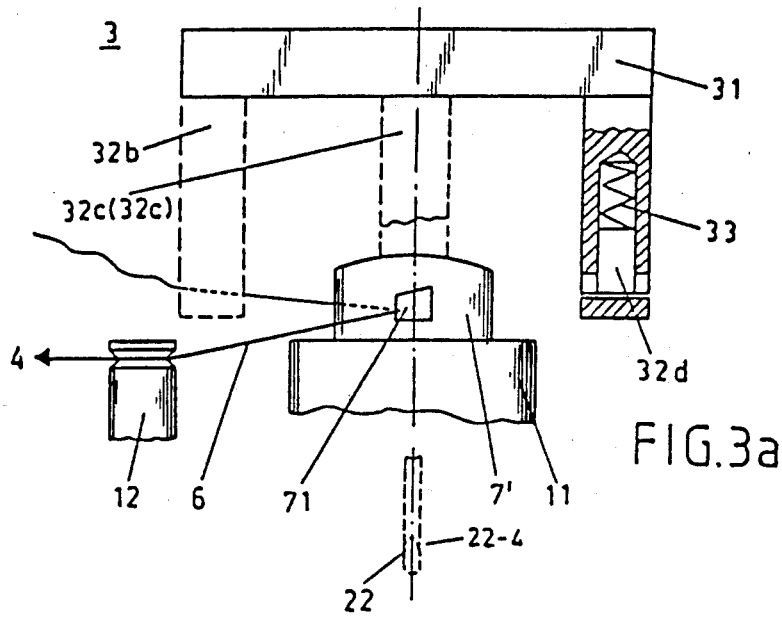
FIGS. 3,3',3'', 3*a*,3*a'*, 3*b*,3*b'*, 3*c* and 3*c'* are detailed representations of a winding unit both in elevation and plan view to illustrate the functional winding operation.
Figure 3A:
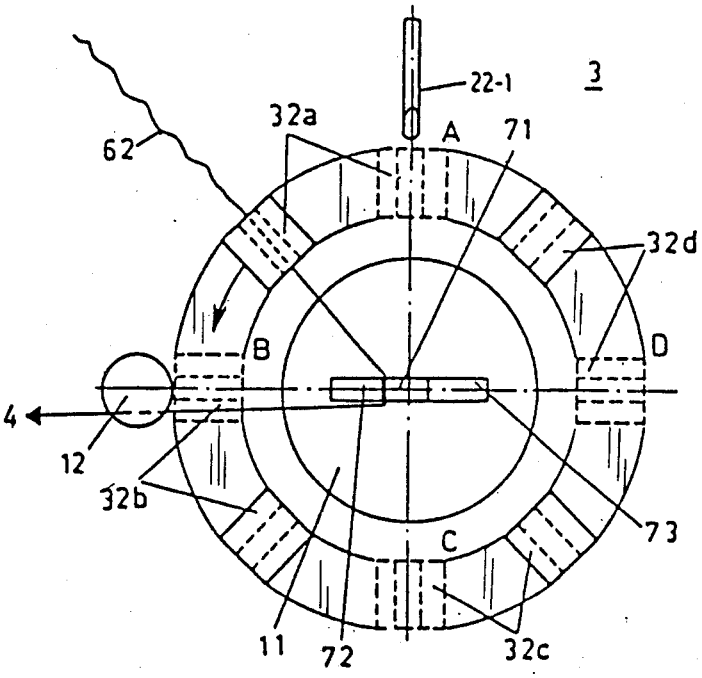
Figure 3B:
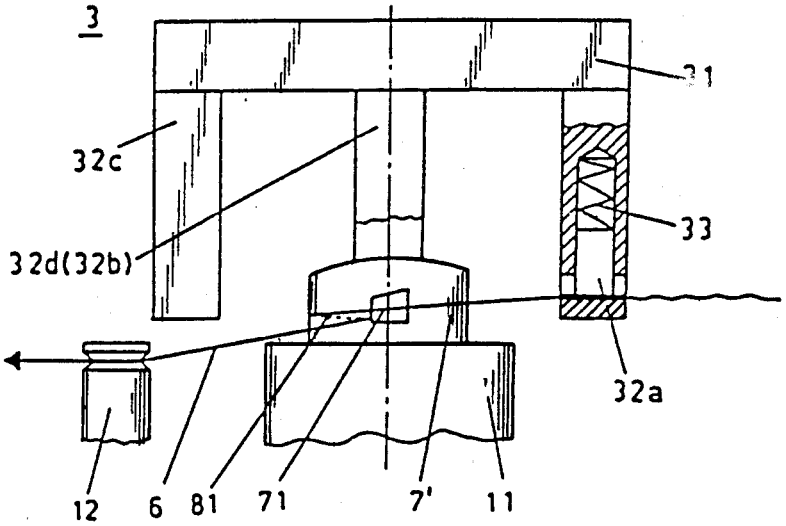
Figure 3B:
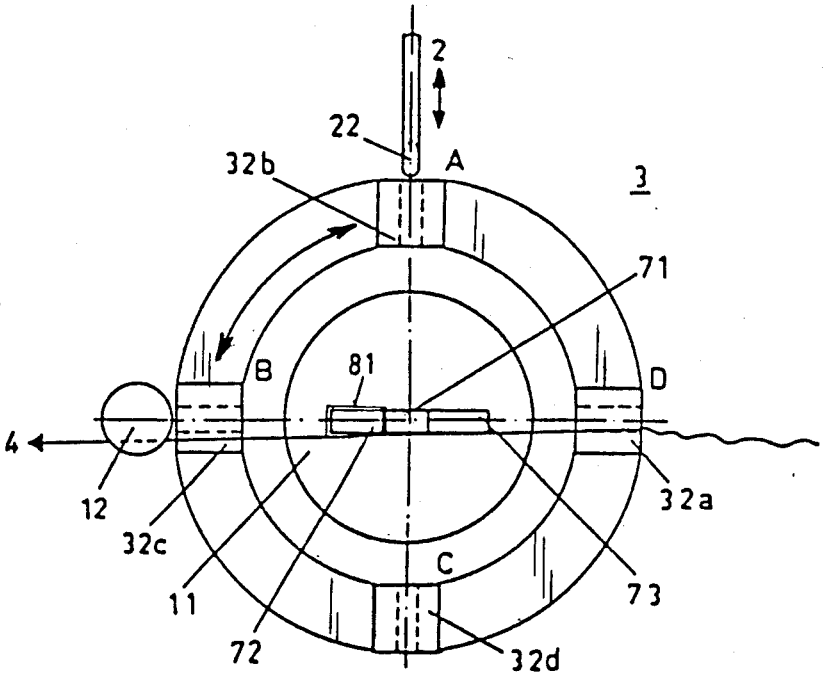

After the winding wire 6 has been cut by the separating device 13, the catch hook 22 is withdrawn once again from the position 22-3 together with the winding wire 6 so that the wire section together with the free wire end 62 is guided in the form of a wire loop 61 first through the core opening 71 in the coil former 7' and then through the still open wire retainer 32a until the catch hook 22 together with the wire end 62 reach the position 22-4. Subsequently, the wire retainer 32a is closed (as shown in FIG. 3b) and the winding wire 6 is thus resiliently retained. In this manner a quarter of a turn (i.e. 90°) of the winding 8 is inserted on the first limb 72 of the coil former 7' in the counterclockwise direction. After the wire retainer 32a is closed, the winding head 31 together with the four wire retainers 32a,32b,32c,32d is rotated in the counterclockwise direction through 270° (in the direction of the arrow shown in full lines) wherein the wire section is held in the wire retainer 32a whilst the other wire retainers 32b,32c,32d rotate freely to form the first turn 81. At the same time, the catch hook 22 is displaced out of position 22-4 (shown dotted) into the initial position 22-1 of the winding position A (FIG. 3a').

At first, the wire retainers 32a,32b,32c,32d rotate out of the positions A,B,C,D, (shown dotted in FIGS. 3a,3a') into the intermediate positions (drawn in full lines) wherein the wire retainer 32a together with the retained wire section is brought into the position D according to FIGS. 3b, 3b' after 270° rotation of the winding head 31 whereupon a complete turn 81 has been applied to the first limb 72 of the coil former 7'. (The wire retainers 32a,32b,32c,32d illustrated as being rotated through 45° in a counterclockwise direction into the intermediate positions in plan view in FIG. 3a' have been left out in FIG. 3a for the sake of clarity.) The second and subsequent turns 81 on the first limb 72 of the coil former 7' are wound in a similar manner to the operation depicted in FIGS. 3,3',3" to 3c,3046270377 c', with the difference being that the winding wire 6 is held in a wire stretcher rather than the wire mount 12'. During the second turn, for example, the catch hook 22 is pushed forwards and back through the next open wire retainer 32b located in the winding position A and the core opening 71, as previously described, whereupon the winding wire 6 is caught and held in the hook. Then the wire retainer 32a located in the position D is opened once again.

Figure 3C:
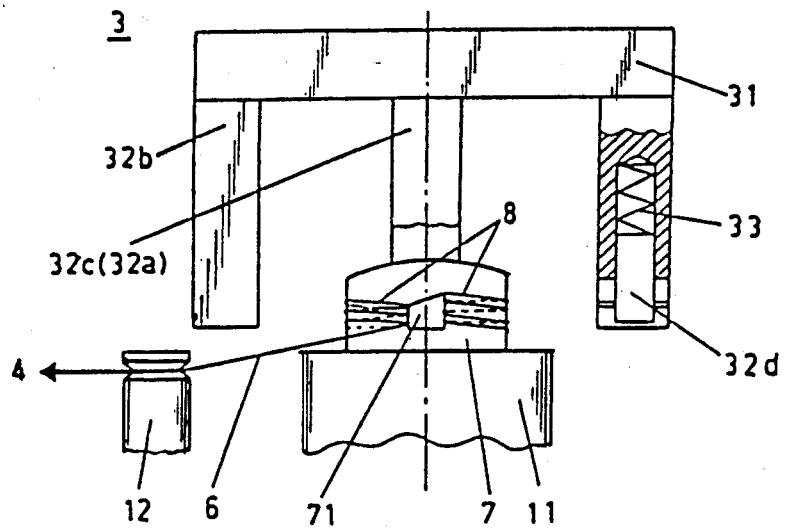
Figure 3C:
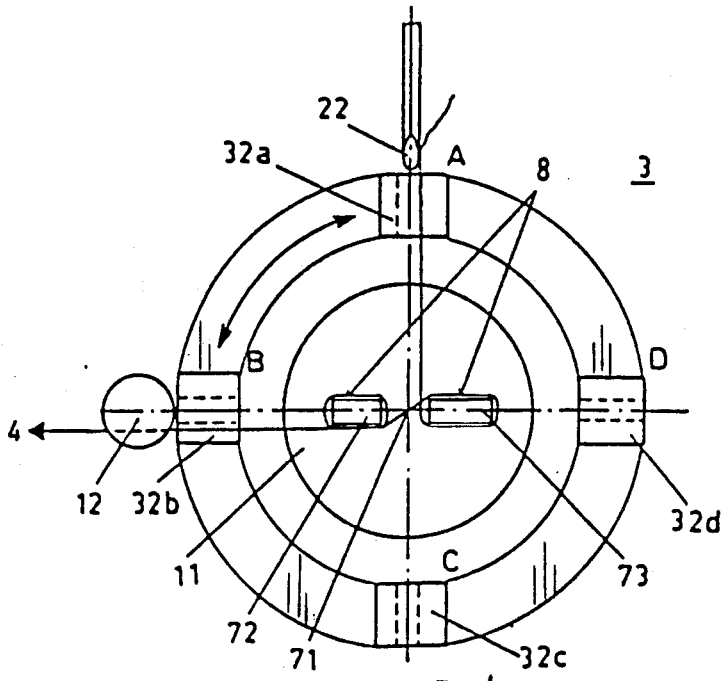

For the sake of illustration it is assumed that four complete turns are applied both to the first limb 72 and to the second limb 73 of the coil former 7'. Consequently, the first wire retainer 32a undergoes three complete revolutions and passes from the position A through the positions B,C,D, etc. once again to the position A, as shown in FIGS. 3c,3c'. After winding of the first limb 72 of the coil former 7' has finished, the winding of the second limb 73 takes place by reversing the winding direction—in the present case in a clockwise manner. In order to prevent a wire connecton within the core opening 71 between the two limbs 72,73 of the coil former 7', a vertical displacement of the wire retainers 32a,32b,32c,32d on the winding head 31 takes place so that the connecting wire from the first to the second limb 72,73 does not pass through the middle of the core opening 71. Rather, it lies at the edge of the core opening 71.

After the catch hook 22 has drawn the winding wire 6 once again as a wire loop 61 through the core opening 71 in the coil former 7' and through the corresponding wire retainer 32a, the wire retainers 32a,32b,32c,32d then rotate in a clockwise direction so that the first turn 81 is wound onto the second limb 73 of the coil former 7'.

After the last, for example fourth, turn 81 the winding of the core coil 7 is terminated, the turret 1 rotates with the latter out of the winding position through 180° into the region of the loading and unloading station 5. At the same time, an unwound coil former 7' that has been moved out of the loading and unloading station 5 into the coil former receiver 11' is rotated into the winding position.

In order to be able to apply the turns 81 substantially in layers, the adjusting device 35 slightly displaces the winding head 31, together with the wire retainers 32*a*,32*b*,32*c*,32*d*, vertically after each turn 81 or continuously. For example, it can move upwards on the first limb 72 of the coil former 7' and downwards on the second limb 73. After each turn of the winding, the wire retainers 32*a*,32*b*,32*c*,32*d* are each displaced 90° relative to their positions prior to the winding of that turn.

In the case where a plurality, for example two, individual independent windings is formed on each of the limbs 72,73 of the coil former 7', the winding of the coil former 7' can take place on two winding apparatuses 2,3 arranged on a support 1 formed, for example, as a round table.

It will be appreciated by those of ordinary skill in the art that the present invention can be embodied in other specific forms without departing from the spirit or essential characteristics thereof. The presently disclosed embodiment is therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. Apparatus for winding electrical coils with coil formers having core openings, comprising:

a turret;

a coil former receiver;

a wire supply device;

a wire mount provided on said coil former receiver for receiving wire supplied from said supply device;

a winding unit including four wire retainers disposed on a rotatable winding head and a wire drawing device having a catch hook, means for moving said catch hook so that it can pass through a wire retainer and the core opening in the coil former; and two wire deflectors adjustably affixed to said turret so that they are laterally adjustable relative to said turret and a separating device for cutting wire to length.

2. Apparatus according to claim 1, further including means for rotating said wire retainers in both the clockwise and counterclockwise directions together with the winding head for winding two limbs of each coil former.

3. Apparatus according to claim 2 wherein said means for rotating said wire retainers rotate said wire retainers 270° for each turn of wire that is wound onto the coil former.

* * * * *